United States Patent [19]

Yoo et al.

[11] Patent Number: 4,653,804

[45] Date of Patent: Mar. 31, 1987

[54] PORTABLE TABLE

[76] Inventors: Jae K. Yoo, 4912-6, Shinkil-dong, Yeongdeungpo-gu; Moo W. Choi, 196-175, Bongcheon-dong, Kwanak-gu, both of Seoul, Rep. of Korea

[21] Appl. No.: 739,409

[22] Filed: May 30, 1985

[30] Foreign Application Priority Data

| | | | |
|---|---|---|---|
| Nov. 30, 1984 | [KR] | Rep. of Korea | 12451 |
| Nov. 30, 1984 | [KR] | Rep. of Korea | 12452 |
| Nov. 30, 1984 | [KR] | Rep. of Korea | 12453 |
| Nov. 30, 1984 | [KR] | Rep. of Korea | 12454 |
| Feb. 23, 1985 | [KR] | Rep. of Korea | 1797 |

[51] Int. Cl.[4] ..... A47B 3/14

[52] U.S. Cl. ..... 297/159; 108/160; 297/139

[58] Field of Search ..... 297/139, 157, 159; 108/34, 35, 38, 131–133, 129, 160; 411/349, 549

[56] References Cited

U.S. PATENT DOCUMENTS

| | | | |
|---|---|---|---|
| 1,368,452 | 2/1921 | Puff | 108/35 |
| 1,873,263 | 8/1932 | Berger | 108/160 |
| 1,888,117 | 11/1932 | Fox | 108/133 |
| 2,217,576 | 10/1940 | Weber | 297/139 |
| 2,325,295 | 7/1943 | Zaleske | 411/549 |
| 2,903,222 | 9/1959 | Levi | 248/439 X |
| 2,983,308 | 5/1961 | Horowitz | 297/159 |

FOREIGN PATENT DOCUMENTS

| | | | |
|---|---|---|---|
| 533244 | 11/1956 | Canada | 108/160 |
| 1054748 | 2/1954 | France | 297/139 |
| 664661 | 1/1952 | United Kingdom | 297/139 |

*Primary Examiner*—Kenneth J. Dorner
*Assistant Examiner*—Peter R. Brown
*Attorney, Agent, or Firm*—David H. Semmes; Warren E. Olsen

[57] ABSTRACT

The present invention relates to a portable and foldable table to be used in open fields as an improvement of conventional portable tables by providing new devices to foldable auxiliary rods, shaft retainers, hinge and lock. With such provisions, the present invention aims at furnishing a strong, stable, simple and graceful portable table.

1 Claim, 24 Drawing Figures

PORTABLE TABLE

CROSS-REFERENCE TO RELATED APPLICATIONS

Prior foreign applications Nos. 12451/12452/12453/12454/ Korea, Nov. 30, 1984 and 1797 Korea, Feb. 23, 1985 under the names of inventors JAE KEUN YOO and MOO WOONG CHOI.

BACKGROUND OF THE INVENTION

1. Field of the Invention

The present invention is an improvement in conventional portable tables. The words "portable table" in this invention means that a table and simplified chairs herein form an integral body wherein as the table is folded in half, it becomes a portable compartment or bag, with chairs being stored in the bag at the same time as the table, per se. Thus, this bag permits either hand-carrying or portability as in a car trunk.

2. Description of the Related Art Including Information Disclosed Under 37 CFR Sections 1.97–1.99

The prior art under 37 CFR Sections 1.97–1.99 is best disclosed by U.S. Pat. No. 4,249,773.

SUMMARY OF THE INVENTION

The improvement of this invention which comprises a portable table and foldable chairs in connection therewith, relates especially to linking rods which insure stability to the table, to the simplification of plural seat frames and the incorporation of an auxiliary rod clip which holds the table chairs when in an unfolded state, to the adaptation of hinges by which it is possible to fold the table in half and to an unique lock which maintains the closed state of the self-contained compartment or bag.

Folding chairs conventionally consisted of chairs with foldable legs and a foldable table which were enabled to be folded in by using foldable linkiing rods and supporting rods and by movably attaching these components on pin shafts. Such a structure seemed to work all right at first glance, but in actual use it was found that it presented a problem of stability. A table should have enough strength and stability to withstand stability against food, dishes, and other containers imposed on it. Nothwithstanding, the designers of conventional foldable chairs gave consideration only to folding, per se, and slighted stability and strength. Its structure comprised linking rods and supporting rods made to support the table by providing an inward slope to them. But when a sitter took a seat or deparated from a seat and impacted on the table, or touched linking rods and supporting rods inadvertently, when the equilibirium of the table collpsed, food and dishes fell down.

The present invention provides solution to such shortcomings of conventional portable chairs by furnishing a measure of prevention of bending. Another structural weakness of conventional chairs was that an auxiliary rod retainer was attached on the seat by welding or rivetting as a separate part, and so this meant addition to the weight and a feature against simplicity, as well as the propensity for the auxiliary rod to be disengaged from the seat. The present invention provides a solution to all the shortcomings cited above, by furnishing an auxiliary rod retainer which is formed by being pushed out from the seat frame. Herein, light weight, simplicity and prevention of rod disengagements are achieved, resulting ultimately in a feature of small volume, low cost and durability.

To cite another feature of this invention, chairs heretofore are a subordinate part of the table which without auxiliary rods, the legs of the chairs cannot retain good strength—the legs being apt to incline right or left. Therefore, auxiliary rods must be foldable, strong in supporting functions, and simple and easy to produce, assemble and use. Auxiliary rods in the present invention are engaged into a clip upon unfolding of the table, and are disengaged upon folding up of the table. They are strong in the unfolded state, of simple structure, and easy to assemble and use.

Another feature of this invention comprises hinges which are attached on the side edge of the table plate so that these hinges would not be seen from the exterior when unfolded. This requirement makes it impossible to use ordinary types of hinges. Therefore, the present invention aims at providing a special kind of hinge which works smoothly when folding up the table into a bag. It also provides protection to the table plate when unfolded.

To introduce still another feature of this invention, conventional foldable tables have the lock of such characteristics that a metal clamp was attached on the top of the bag (of one half of the bag) using a hinging shaft so that the clamp may pivot around it. On the counterpart position of another half of the bag, a metal piece was fixed as abutment means when the clamp was tightly hung on it. Such complicated kind of lock structure requires much labour costs in manufacturing, invites frequent disorder, occupies a large area, and destroys good appearance.

The present invention provides knobs protruding from the both halves of the table as in integral part, and in these knobs a lock is housed which is simple and convenient to manufacture, free of disorder, easy to use, and attractive to look at.

Further objects and features of the present invention will be apparent from the following specification and claims when considered in connection with accompanying drawings illustrating the preferred embodiment of the invention.

DESCRIPTION OF THE PREFERRED EMBODIMENTS

Figure 1:
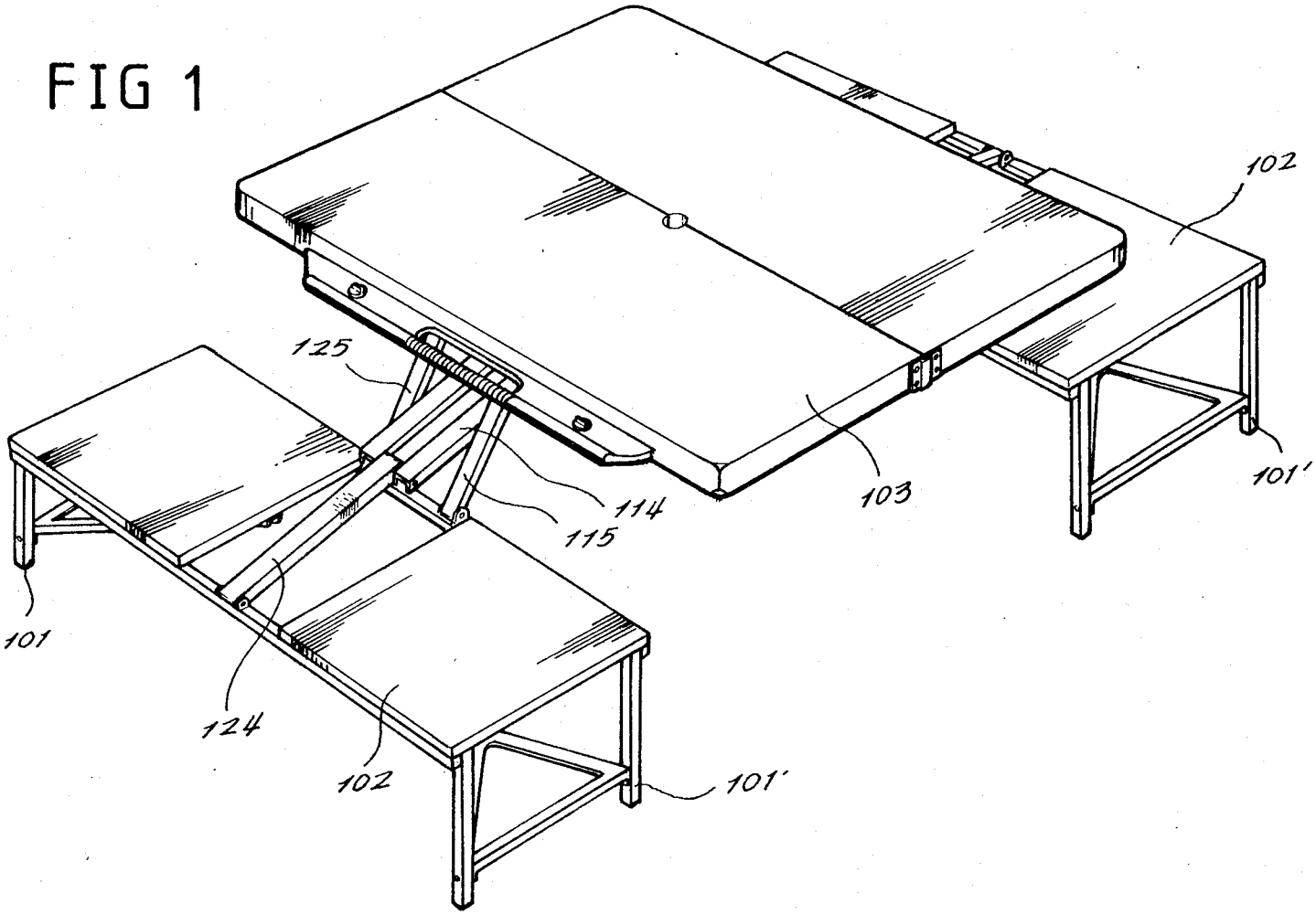
FIG. 1 is a perspective view of the fully unfolded table.
Figure 2:
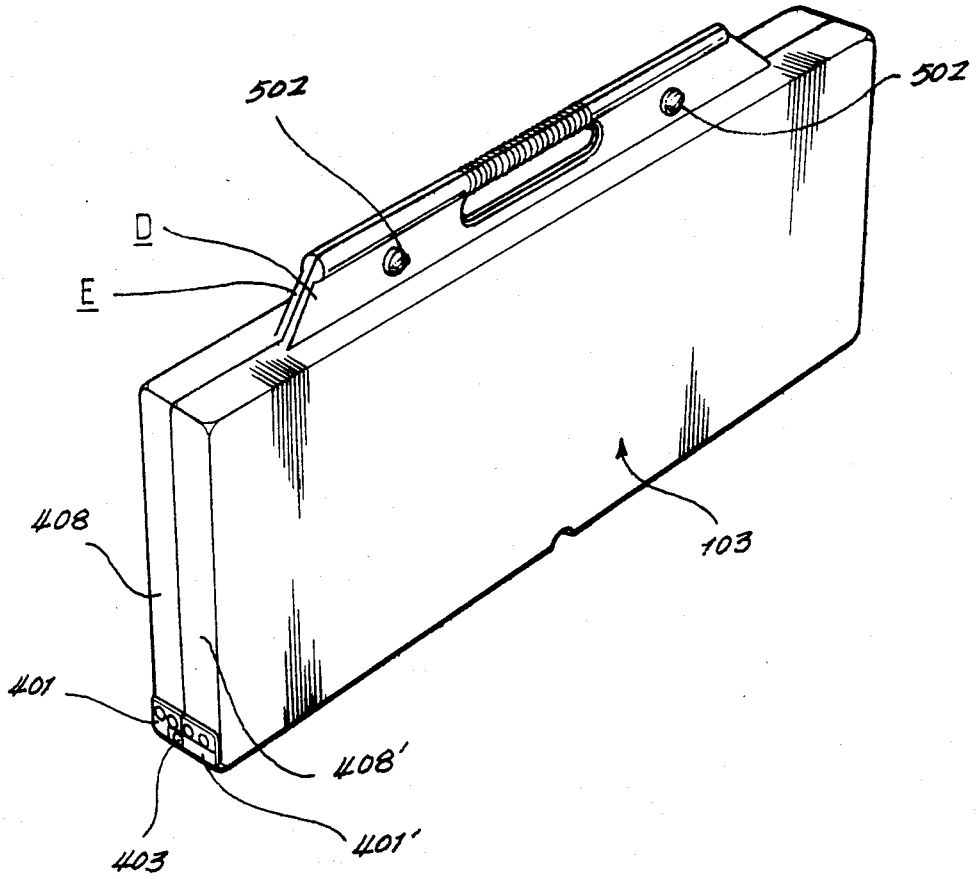
FIG. 2 is a perspective view of table compartment or bag after folding up.
Figure 3:
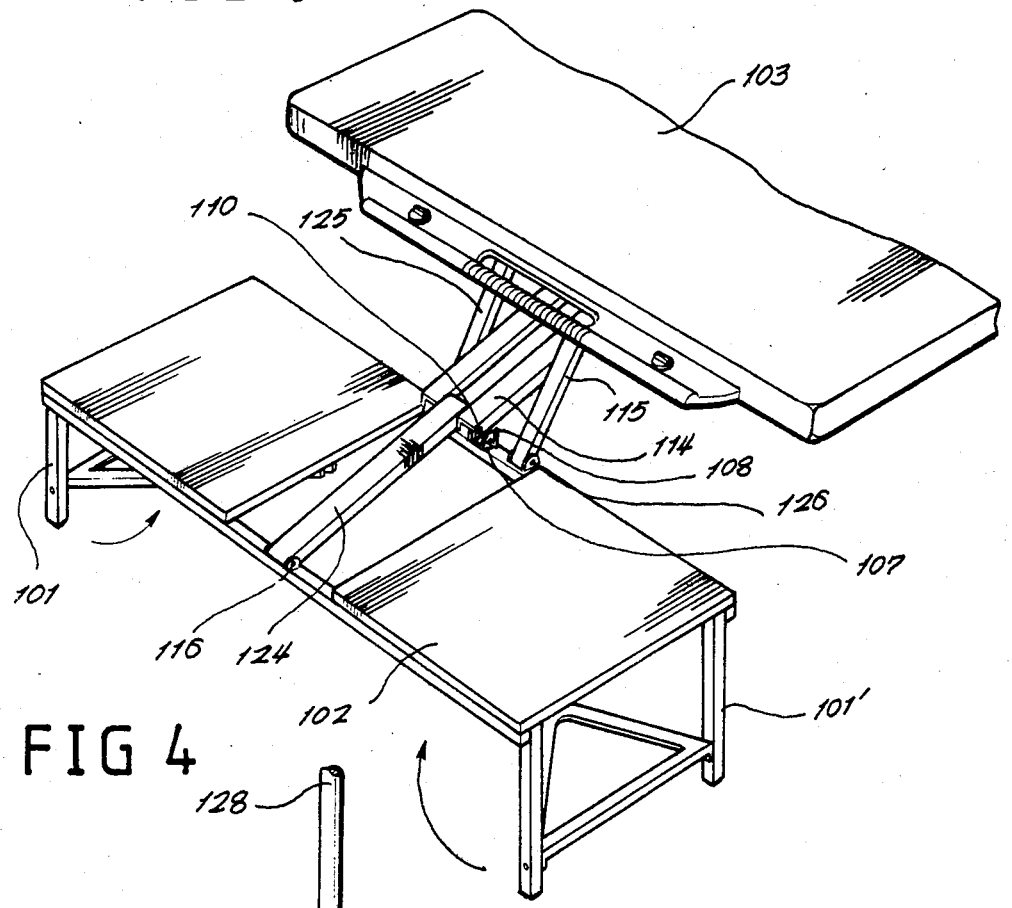
FIG. 3 is a portion of the table and one chair element connected by means of linking rods.
Figure 4:
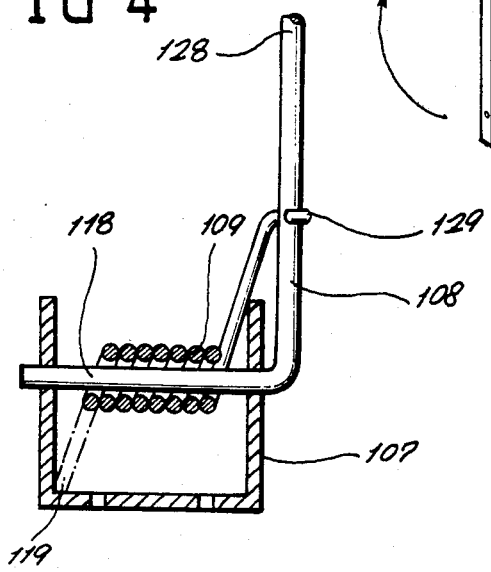
FIG. 4 is a side view of the FIG. 3 supporting part in detail.
Figure 5:
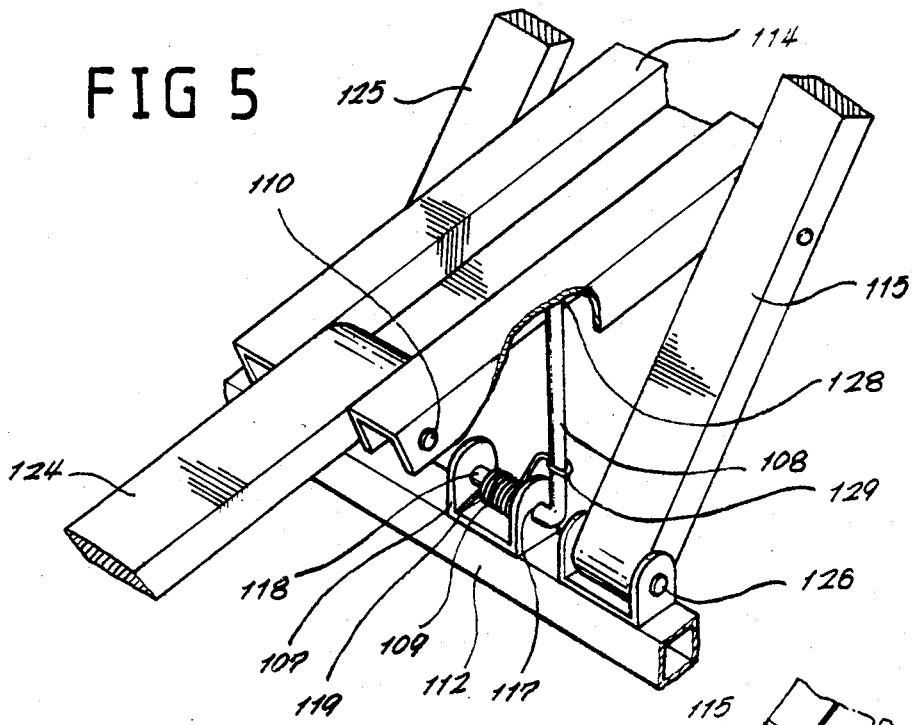
FIG. 5 is a detailed perspective view of assembled linkage rods and support part of FIG. 3.
Figure 6:
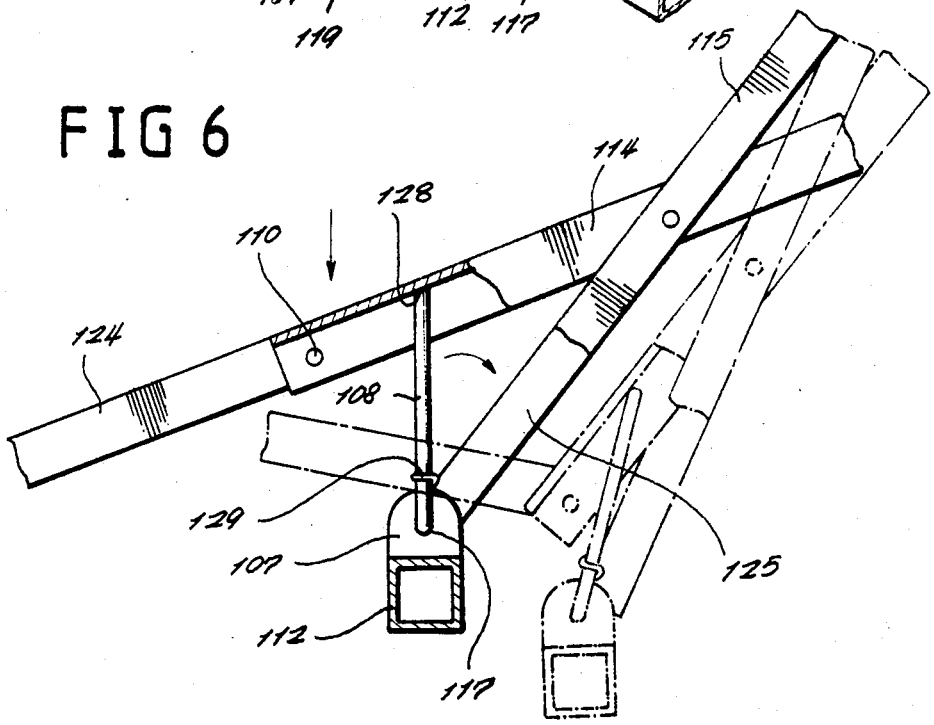
FIG. 6 illustrates movements of these FIG. 5 parts.
Figure 7:
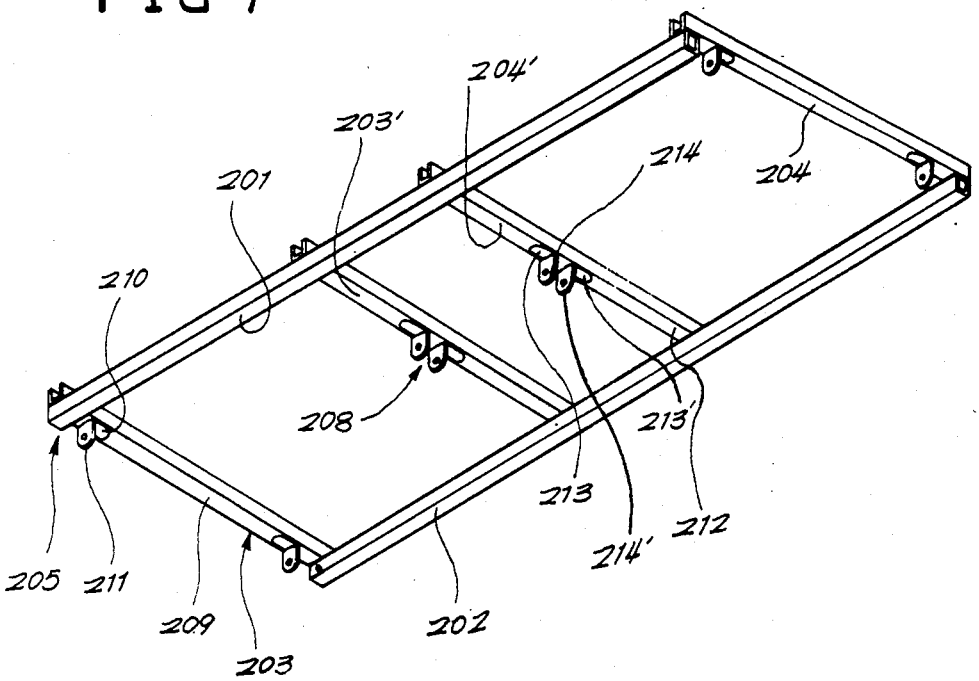
FIG. 7 shows the whole superstructure of seat.
Figure 8:
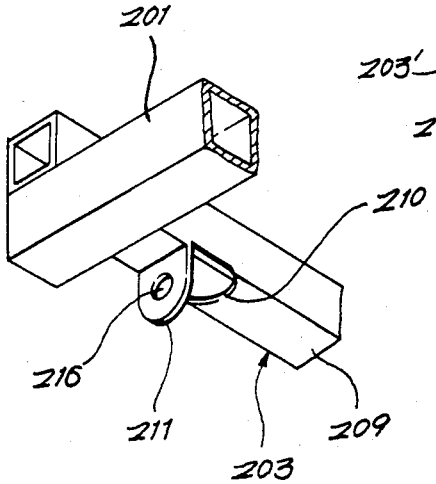
FIG. 8 in both (I) and (II) shows auxiliary rod retainer of FIG. 7 in detail.
Figure 22:
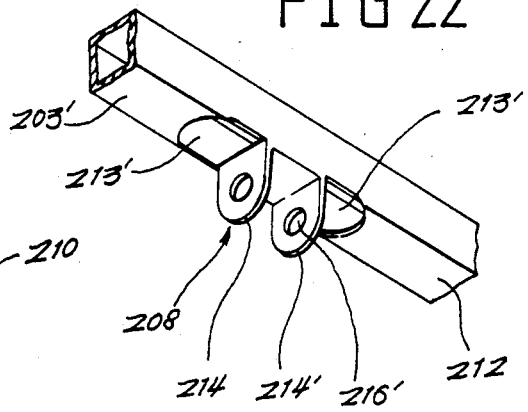
Figure 9:
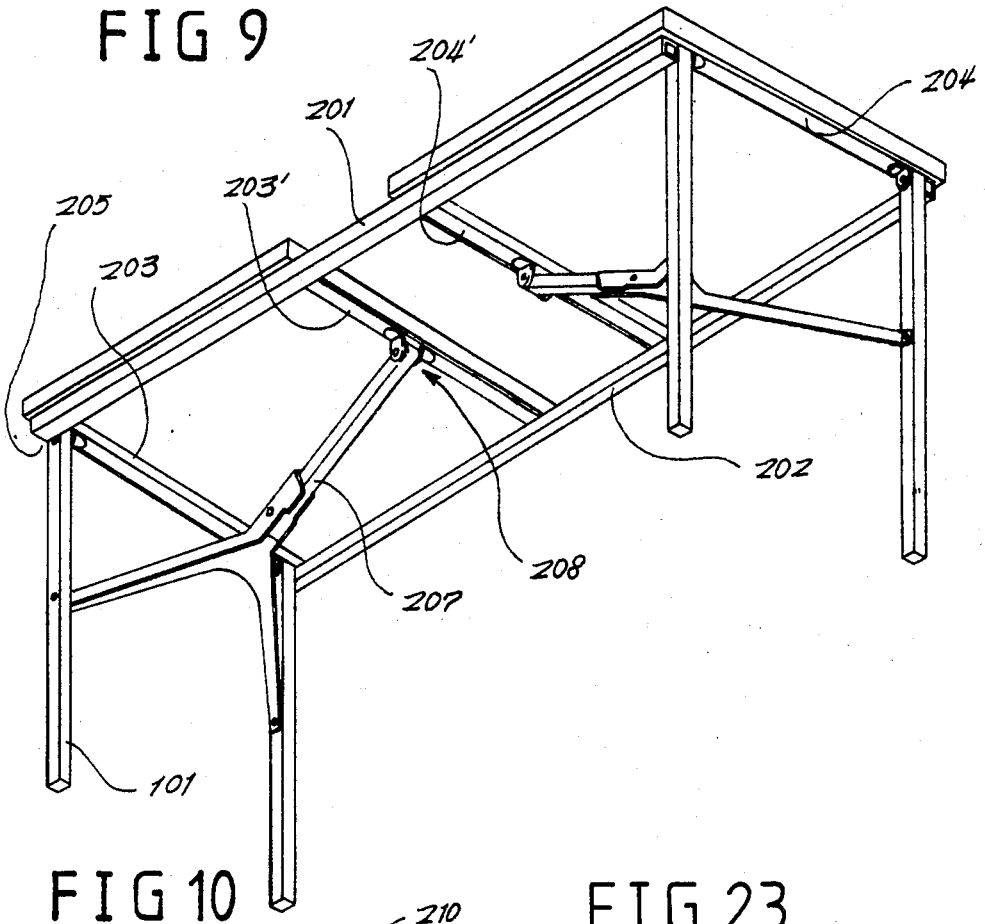
FIG. 9 shows the assembled state of one whole chair frame.
Figure 10:
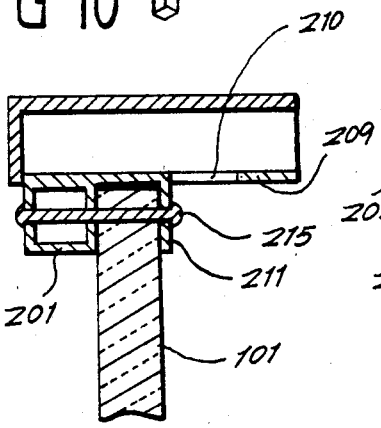
FIG. 10 in both (III) and (IV) shows the cross-sectional view of FIG. 9 joint of rod retainer and auxiliary rod.
Figure 23:
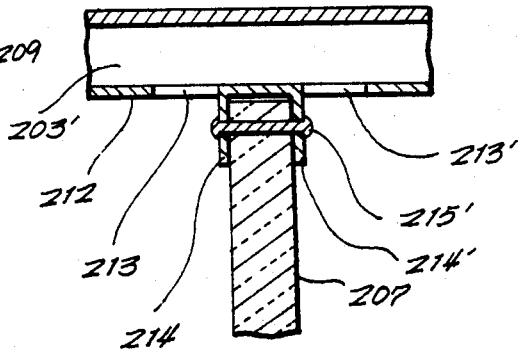

Broadly, the invention comprises a foldable and portable integral table-and-chair device which comprises at least two table members pivotally attached to provide a planar table surface and to provide an alternate folded boxed configuration with the boxed configuration having a securing means to retain the boxed configuration. It also includes a plurality of chair members incorporated in a pivotally-folded condition with the table members to be included and enclosed in the boxed or bagged configuration with the chair members having structural facility to rotate from the enclosed boxed configuration through approximately 180° to assume releasably locked positions whereby the chair surfaces of the chair members are positioned adjacent to and parallel with the planar table surface, and with each of the chair members having pivotally rotatable and lockable supporting members at each end thereof, whereby the chair surfaces are maintained in substantially horizontal attitude. The planar table surface is supported and maintained in a substantially rigid condition by the pivotally locked supporting members which are structurally configured to rotate from the locked supporting attitudes and to collapsibly fold and nest into the lower sides of the chair members beneath the chair surfaces.

FIGS. 1 through 6 show that chairs (102) and table (103) are connected to each other through upper and lower linking rods (114)(124) and suporting rods (115)(125), the former having a middle-folding-feature, and the latter and former being movably joined together by means of pin shafts (116)(126). Linking rod 124 extends from its pivot on rod 114 to the outer side of the chair where it is pivotally secured to the chair frame. In this foldable table, a U-type retainer is attached at the centre of the top of inner longitudinal frame (112) of chair (102); the bent portion (118) of supporting part (108) is inserted through hole (117) and coil spring (109) so that coil spring ends (119) (129) may elastically push retainer (107) and supporting part (108) in opposite directions; such that the upper portion (128) of supporting part (108) vertically supports the bottom of the linking rod (114). Support 108 is spring-biased pivotally on chair frame 112 with its force end slidably engaging the upper linking rod 114.

A description is presented below on how to fold back the unfolded table.

Part No. 110 is a pin shaft. Legs (101)(101') at the bottom of chair (102) are folded inward (along the direction of arrow), linking rods (114)(124) between chair (102) and table (103) are also folded, and then, they are put into both halves of table (103) from each connected side. If linking rods (114)(124) are to be folded, supporting part (108) should be pushed inward, then at the same time, the upper portion (128) of supporting part (108) is inclined and switched without difficulty under linking rods (114). After that, if the two halves of the table are combined together, the whole unit becomes a bag.

On the other hand, if the table is to be set up, the two halves of table are opened wide pivotally at its hinges, and the chairs are pulled out, so that linking rods (114)(124) may be opened pivotally to pin shaft (110) to become a straight line. Also, supporting rods are unfolded to form a straight line slope. Thus unfolded, supporting continuity part (108) under the linking rod (114) stands up vertically because of the elastic force of spring (109), supporting strongly the linking rod (114). Then, by pulling legs (101)(101') downward, the setting-up task is completed. The only thing now left is to select even ground to make the face of the table reasonably horizontal. Because supporting part (108) is supportinhg linking rod (114) vertically and strongly, table (103) is secure and can withstand against rough use in open fields.

To refer to FIGS. 7 through 10, an auxiliary rod retainer (211) is punched out from the base plate (209) as an integral part with the base plate (209), leaving a hole (210) of a contour of gentle curve, and this retainer (211) is let to confront longitudinal pipe frames (201)(202). In the same way, auxiliary rod retainers (214)(214') are punched out from the centre of base plate (212) of latitudinal frames (203')(204') as integral parts with base plate (212), leaving holes (213)(213') on base plate (212), and these parts are let to stand upright, and to confront each other.

Therefore, legs (101) are attached onto auxiliary rod retainers (211) which are punched out from base plates (209) of longitudinal frames (201)(202) and latitudinal frames (203)(204). These movable attachments are made by means of joining shaft (215) which pierces both retainer hole (216) and leg (101), so they can be folded up onto the seat. Foldable auxiliary rods (207) are movably attached to retainers (214)(214') which are on latitudinal frames (203')(204'). These movable attachments are made by means of joining shaft (215') which pierces retainer hole (216') and foldable shaft (207), so they can be folded up onto the seat. Therefore, the process of manufacturing a separate rod retainer is omitted, and the cost of welding up this part is also saved. Such use of a punched out retainer as an integral part with the seat frame helps minimize the weight of the present device, and also is a proof against disengagement of the retainers.

Figure 11:
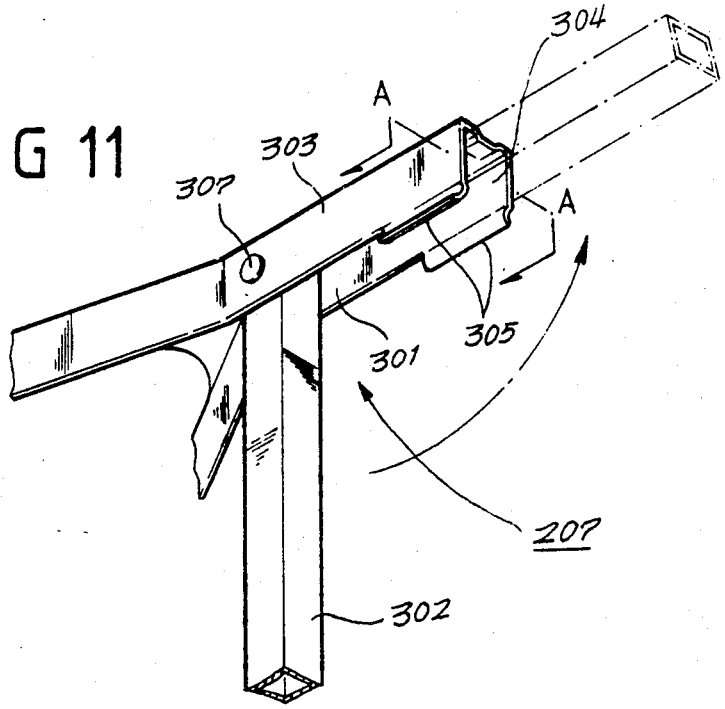
FIG. 11 is a perspective view of auxiliary rod clip.
Figure 12:
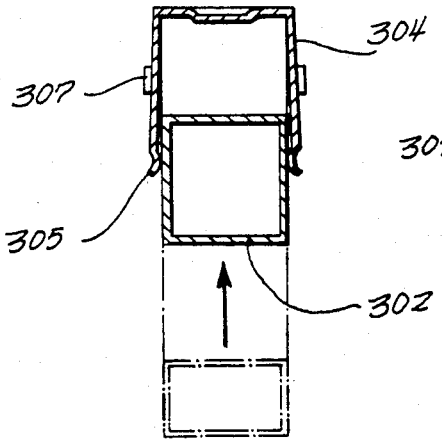
FIG. 12 in both (V) and (VI) shows the cross-sectional views of the joints between auxiliary rods and clips taken through the line AA in FIG. 11.
Figure 24:
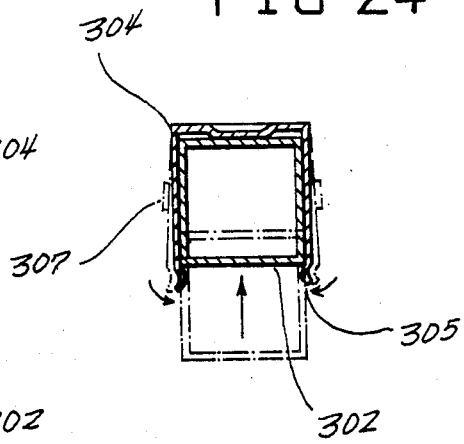
Figure 13:
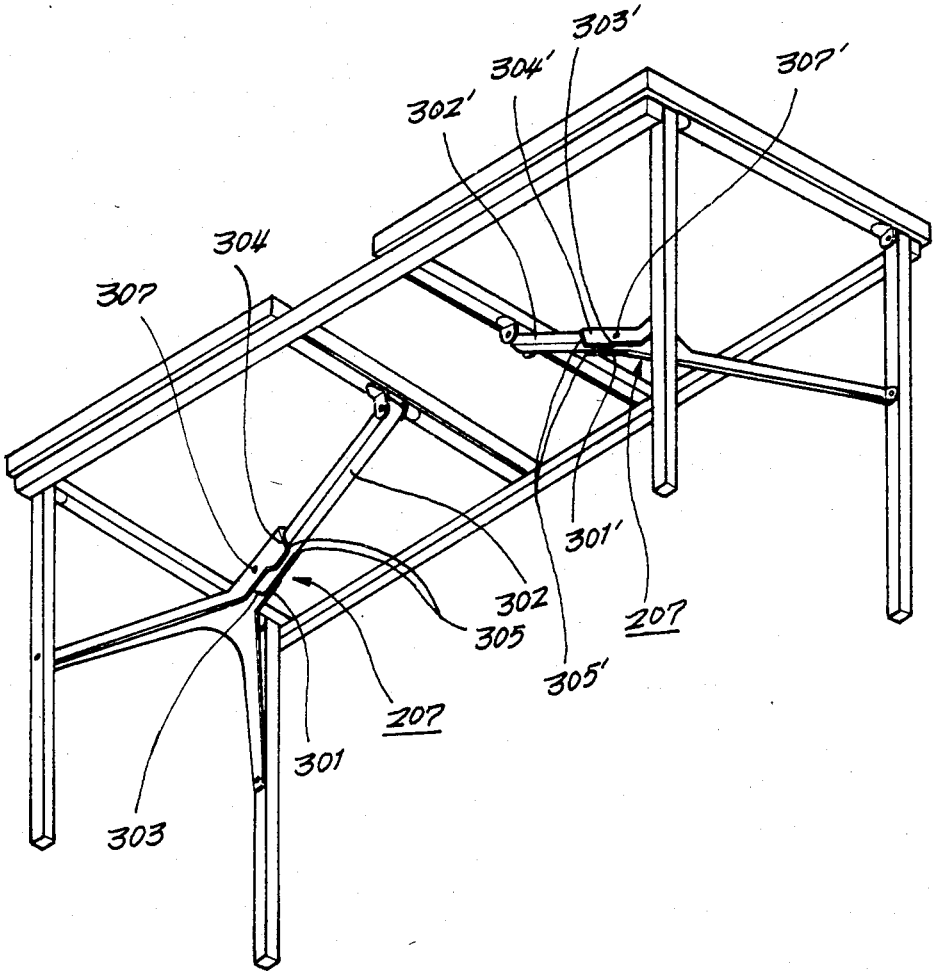
FIG. 13 is the whole assembly of a chair frame.
Figure 14:
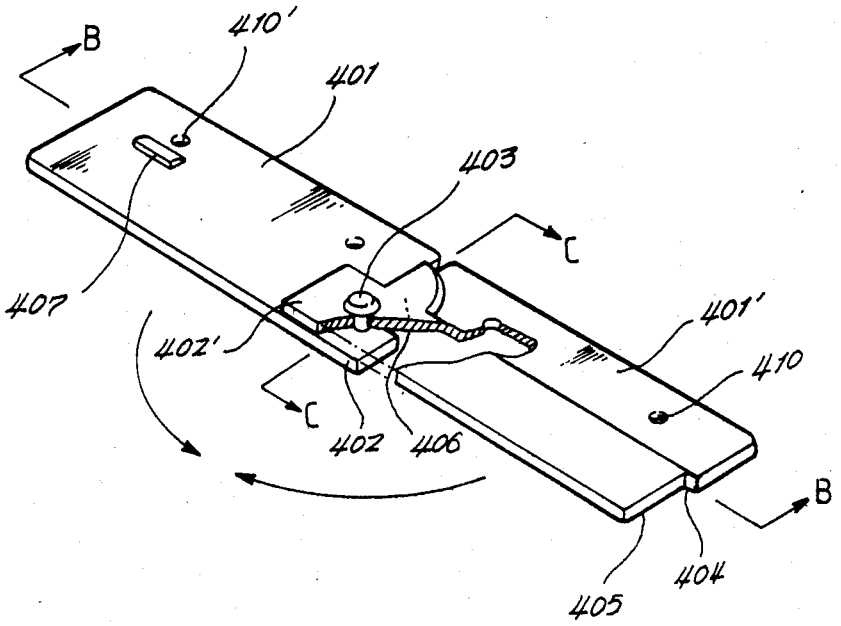
FIG. 14 is the entire structure of a complete hinge, reference FIG. 2.
Figure 15:
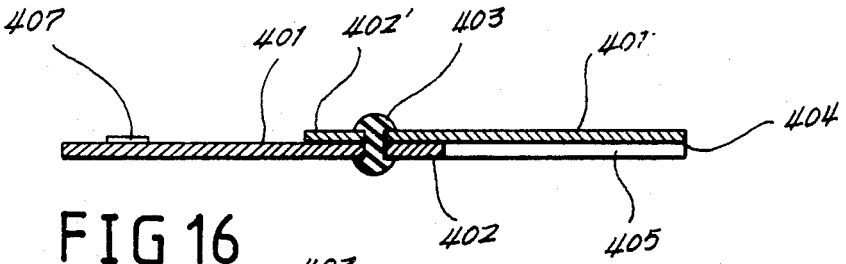
FIG. 15 is a cross-sectional view of hinge taken through B—B of FIG. 14.
Figure 16:
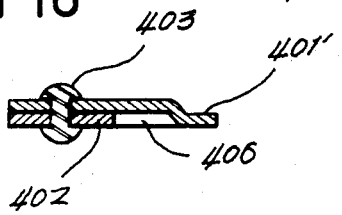
FIG. 16 is a cross-sectional view of hinge taken through C—C of FIG. 14.
Figure 17:
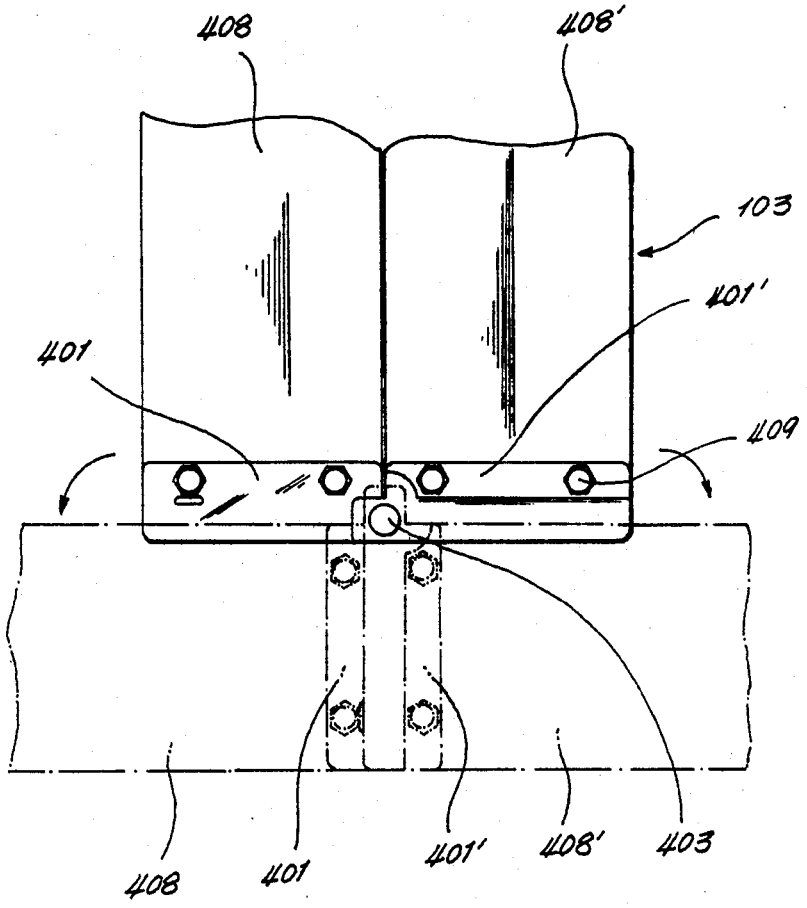
FIG. 17 shows the attachment of the hinge on the edges of the bag after folding.
Figure 18:
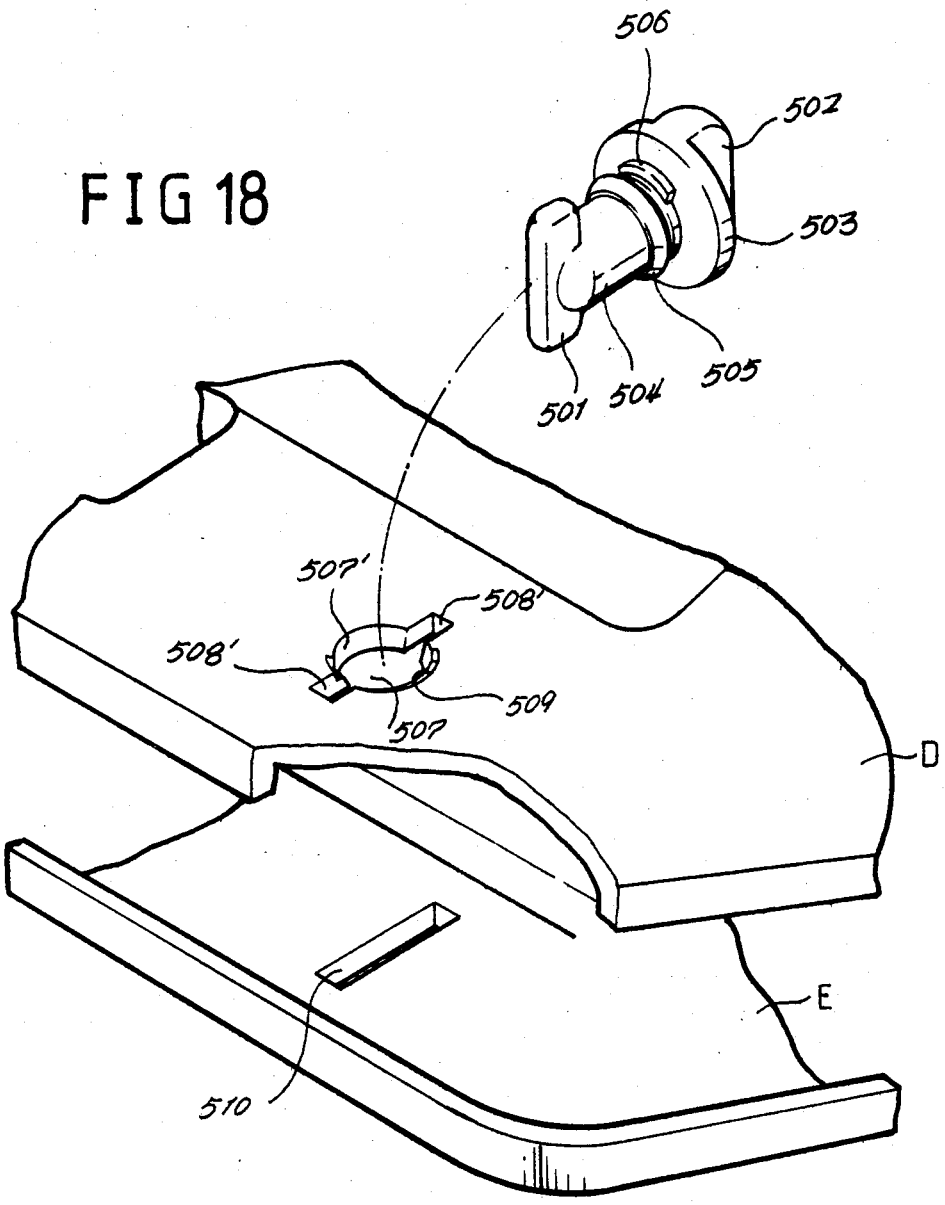
FIG. 18 is a perspective view of the disassembled state of the lock.
Figure 19:
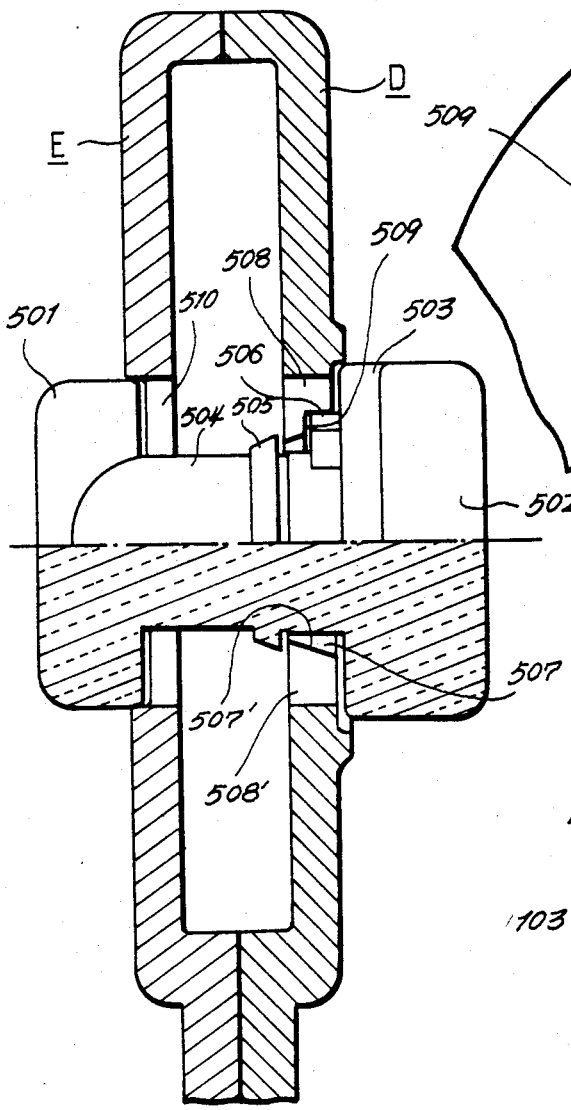
FIG. 19 is an enlarged cross-sectional view of the lock.
Figure 20:
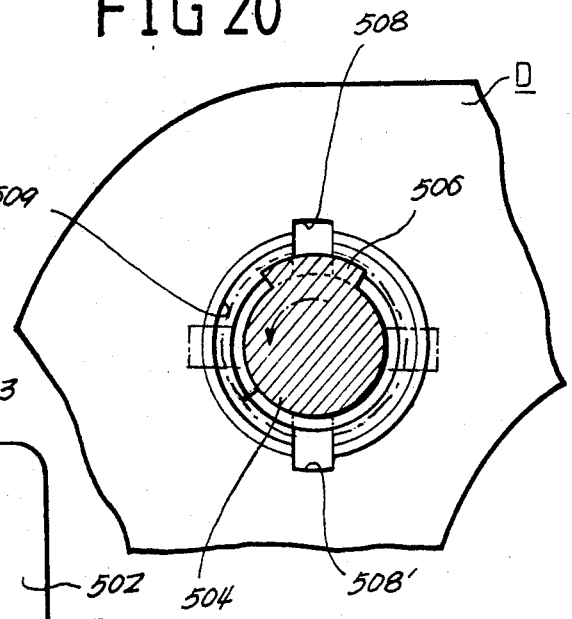
FIG. 20 is a transverse cross-sectional view of the assembled lock.
Figure 21:
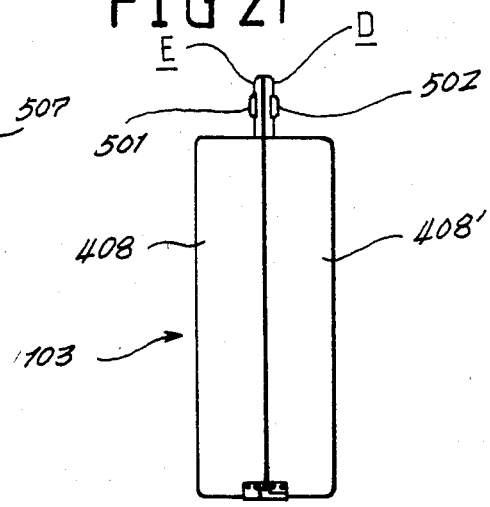
FIG. 21 shows a side view of the bag, indicating where the lock is attached.

Referring to FIGS. 11 through 13, channels (303)(303') at the tip of the lower arm surround angular piped upper arm (302) (302') on three sides, and at an extension of the channel there is formed a clip (304)(304') by arranging small protrusions (305) (305') along the edges of the channels. Coded numbers 207 and 207' are foldable auxiliary rods, and 307 and 307' are the pivoting shafts for foldable auxiliary rods.

If the clip is to be engaged, the folded auxiliary rods (207)(207') are open wide pivotally to the shaft, so that the rectangular pipes (302)(302') of the upper arms can be guided inside the small protrusions (305)(305') through the under-directed mouth of clips (304)(304'). Because the holding property of the protrusions (305)(305') of clips (304)(304'), the upper arm is securely engaged in clip (304), with the whole auxiliary rod in a straight line. If auxiliary rod (207) is to be folded back, the reverse procedure can be applied.

Further, as clip (304)(304') is an extension of the lower arm, the engagement between clip (304) and rectangular pipe (302) is strong and secure, ultimately making the legs of the chair strong and secure. Also, the simplicity of auxiliary rod makes manufacture, assembly and use easier.

Referring to FIG. 14 through FIG. 17, the portions (402) (402') of two metal pieces are joined together by means of hinge shaft which is accommodated in the overlapping portions. The limit of the overlapping portion of the upper element (401') is provided on the lower edge of the metal piece at the stop (404). Space (405) is provided for accommodation of the lower part of metal piece (401), and the left portion 402) is halted at the other end at a stop (406). There is another stop (407) on the left metal piece (401) for stopping the right metal piece (401').

Shaft (403) of hinge described above is attached to the bottom of the centre line of the bag, and the hinges are so attached that the edges of the bottom of the bag and the lower edges of the metal pieces of the hinge are made even.

The means of attachment are fasteners (409) which are driven through holes (410)(410') on metal pieces (401)(401').

Therefore, if box-type table plates (408)(408') (foldable mechanisms are stored inside these plates) are folded with the open sides inward, shaft (403) of the hinge reaches the end of the joining line between table plates (408) and (409), and so, the two table plates are tightly joined to each other. (Refer to FIG. 17 for the illustration in solid lines). When the table plates (408)(408') are open, the metal pieces of the hinge are folded contrarily (refer to FIG. 17 for the illustration in dotted lines), and at this moment, the lower portion of left metal piece (401) is housed into space (405) of right metal piece (401'). At the same time, its end touches stop (404), and the lower portion of right metal piece (401') touches protrusion (407), and therefore, the hinge does not receive any pressure from the table plates. Here, protrusion (402) is in guiding space (406) when the metal pieces are in movement.

Therefore, the hinge maintains correct position whether the device is unfolded to form a table, or it is folded back into a bag. When the device is being unfolded, the hinge receives a certain kind of pressure from both halves of the table, and thereby, the stretched table face becomes absolutely flat, and the hinge gets hidden under the stretched table plates.

Referring to FIGS. 18 through 21, the lock is installed in a quantity of one or two on the plates (D)(E) of the knob of the bag. At the tip of lock shaft (504) which is extended from round head (503), there is formed a cross bar (501) as an integral part of shaft (504), making a T-shape together with shaft (504). On lock shaft (504), there are a convex projected ring (505) and halting protrusion (506). Lock shaft (504) is inserted through hole (507) which is located on right plate (D) of the knob of the bag.

Along the wall of hole (507), there are two grooves (508) (508') confronting each other across the centre of hole (507), and these grooves (508)(508') are covered by the round head (503) after insertion of the lock. The inner wall of hole (507) is of concave form (507') for accommodation of convex projected ring (505).

If lock shaft (504) is initially inserted in hole (507), convex projected ring (505) is let to touch the entrance of concave inner wall (507'), and lock shaft (504) is hit slightly by hand, then convex ring (505) is pressed into concave inner wall (507') to be housed there, and lock shaft (504) completely pierces hole (507). Thus, the upper portion of lock shaft (504) is engaged into shaft hole (507), and is not easily disengaged.

During the insertion of lock shaft (504), grooves (508) (508') facilitate the insertion, and the maximum diameter of convex projected ring (505) is designed slightly larger than the minimum diameter of concave inner wall (507') in order to prevent disengagement.

Halting protrusion (506) on lock shaft (504) is accommodated in circular groove (509) which is located at the entrance of shaft hole (507). The length of circular groove (509) is designed such that the length equals the length of halting protrusion (506) plus one quarter of the circumference of shaft hole (507). Therefore, if lock shaft (504) is turned, it does not rotate more than 90 degrees.

On the left plate (E) of the knob of the bag, there is provided a long opening (510) for driving-through of cross bar (501). This long opening (510) should be an overlapping relation to grooves (508)(508').

If handle (502) of lock shaft (504) is turned 90 degrees after insertion of cross bar (501) through long opening (510), then the bag is in a locked state, and the two halves of the bag are tightly held together.

Therefore, the length of lock shaft is designed such that the length is to be enough to hold the left and right plates of the knob tightly together in the locked state.

If the bag is to be opened, a reverse procedure is performed by turning lock shaft (504) 90 degrees the opposite way, and thus cross bar (501) is disengaged from long opening (510) at the position of overlapping between cross bar (501) and long opening (510).

As described above, lock shaft (504) turns within 90 degrees only, and therefore, its operation is simple, and its function is sure. Its cross bar and handle form an integral part of each other, and the shaft hole and the long opening for the lock are formed at the time of the performing of the plates of the knob itself. Such simplicity of structure is the guarantee against occurrence of disorder during use. The manufacturing of parts is also very simple and easy. For example, the shaft hole and related mechanism are covered by the round head when the lock is engaged, exposing only the handle and cross bar. Such a feature of the lock makes its external appearance simple and attractive.

As introduced above, the present device has such particular features that the table is secure and stable when set up, the seat of the chair is simple and lightweight, and function of the clip which holds the auxiliary rod is sure and solid, operation is simple, the hinge maintains the table plates at correct position, lock operation and manufacture are simple and it is the purpose of the present invention to provide a foldable field table with such features.

We claim:

1. A foldable and portable integral table and chairs therefor comprising:

(A) at least two table members hinged together at ends thereof to provide a planar table surface and an alternate folded box configuration, said table members bearing opposed locking hinges at each end thereof, wherein a hinge shaft is offset from edges of leaves of the hinge;

(B) chair members secured in pivotally foldable relation to each said table member to be enclosed in the box configuration, said chair members forming chair surfaces and inner and outer longitudinal frame members beneath the chair surfaces, each of said chair members having pivotally rotatable and lockable legs at each end thereof and at least one foldable auxiliary rod engaging interconnecting respective legs to each chair member by means of auxiliary rod retainers, means on the foldable rod to lock the rod in an extended position thereby locking the legs into upright position whereby said chair members are maintained in substantially horizontal attitude; said pivotally locked chair legs being structurally configured to rotate from said locked supporting attitudes and to collapsably fold and nest into said chair members beneath them;

(C) upper and lower links pivotally joining respective table and chair members medially, the lower of said links overlying and having pivotal connection with both the outer frame of the chair and the upper link, the upper of said links also having pivotal connection with the table; two supporting rods, one on each side of the upper link, likewise pivotally engaging endwise each chair and table member as well as engaging the upper of said links medially and externally; spring-biased link support means pivotally disposed upon the inner chair frame member and which abuts the upper link in slideable supporting relation thereto, whereby upon opening of the table and chair members, the respective links are urged upwardly into fixed, straight-line extension of each other, the said links being stablized by the supporting rods and whereby upon closing of the table and chair members, the respective upper and lower links, the supporting rods and spring-biased support means will collapse in nesting relation to the table and chair members, said chair members having structural facility thereby to rotate from enclosed boxed configuration through approximately 180 degrees to assume releasably locked positions, whereby the chair surfaces of the chair members are positioned subjacent and parallel to the planar table surface, (D) indented locking means in extension of respective table members to retain the boxed configuration.

* * * * *